US008204403B2

(12) United States Patent
Nowak et al.

(10) Patent No.: US 8,204,403 B2
(45) Date of Patent: Jun. 19, 2012

(54) TWO-COLOR IOI DRUM MODULE ENABLING N-COLOR MONOCHROME, HIGHLIGHT, FULL COLOR, PHOTOTONE COLOR AND EXTENDED COLOR ARCHITECTURES

(75) Inventors: William J. Nowak, Webster, NY (US); Dale R. Mashtare, Bloomfield, NY (US); Thomas C. Hollar, Penfield, NY (US); Daniel W. Costanza, Webster, NY (US); Robert P. Loce, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 443 days.

(21) Appl. No.: 12/478,024

(22) Filed: Jun. 4, 2009

(65) Prior Publication Data

US 2010/0310271 A1 Dec. 9, 2010

(51) Int. Cl.
*G03G 15/00* (2006.01)
*G03G 21/18* (2006.01)

(52) U.S. Cl. ..... 399/110; 399/107; 399/112

(58) Field of Classification Search ..... 399/107, 399/110, 111, 112
See application file for complete search history.

(56) References Cited

U.S. PATENT DOCUMENTS

| | | | | |
|---|---|---|---|---|
| 5,008,691 | A | 4/1991 | Kumasaka et al. | |
| 5,030,531 | A | 7/1991 | Goodman | |
| 5,208,636 | A * | 5/1993 | Rees et al. | 399/159 |
| 5,837,408 | A | 11/1998 | Parker et al. | |
| 6,240,271 | B1 | 5/2001 | Shimazawa et al. | |
| 6,332,066 | B1 * | 12/2001 | Yanagawa | 399/302 |
| 6,615,009 | B2 * | 9/2003 | Hosoya et al. | 399/111 |
| 7,010,254 | B2 | 3/2006 | Takeuchi et al. | |
| 7,751,746 | B2 * | 7/2010 | Miyawaki et al. | 399/107 |
| 2007/0122186 | A1 * | 5/2007 | Kamimura | 399/110 |
| 2007/0212107 | A1 * | 9/2007 | Lewis et al. | 399/107 |
| 2008/0240788 | A1 | 10/2008 | Mashtare et al. | |
| 2009/0169251 | A1 * | 7/2009 | Itabashi | 399/115 |
| 2010/0142990 | A1 * | 6/2010 | Mandel et al. | 399/107 |
| 2010/0310272 | A1 * | 12/2010 | Mashtare et al. | 399/107 |

OTHER PUBLICATIONS

Lux et al., "Is Image-on-image Color Printing a Privileged Printing Architecture for Production Digital Printing Applications?", Xerox Corporation, date unknown.

* cited by examiner

*Primary Examiner* — David Gray
*Assistant Examiner* — Rodney Bonnette
(74) *Attorney, Agent, or Firm* — Oliff & Berridge, PLC

(57) ABSTRACT

A xerographic marking device includes a media transport path and at least one two-color image-on-image (IOI) drum module. Each two-color IOI drum module includes in a process order around a photoreceptor: a) a first charging unit; b) a first exposure unit; c) a first development unit; d) a second charging unit; e) a second exposure unit; and f) a second development unit, wherein the intermediate transfer unit receives a first toned image and a second toned image from the photoreceptor in a single transfer and transfers those toner images to print media to produce a toned image on print media. In various embodiments, the xerographic marking device is modular and includes a common paper transport module having a cavity and a marking engine sized to fit within the cavity.

20 Claims, 15 Drawing Sheets

TWO-COLOR IOI DRUM MODULE ENABLING N-COLOR MONOCHROME, HIGHLIGHT, FULL COLOR, PHOTOTONE COLOR AND EXTENDED COLOR ARCHITECTURES

BACKGROUND

The disclosure is directed to a compact and robust two-color image-on-image (IOI) universal marking module serving as an adaptable building block in a xerographic marking device to provide diverse functionality including monochrome, highlight color, full color, phototone color, and extended gamut color marking needs using a common marking engine platform.

Several different color printing technologies have emerged in recent years. Early color xerography was accomplished by developing single color images onto a photoreceptor drum and then performing individual transfers of the single color images onto a substrate, such as paper, or onto an intermediate material, to build up a full color image. Xerox products using this technology included models 6500, 5775, and DC12. To improve quality, two particular competing marking architecture technologies were developed: tandem and image-on-image (IOI) technologies. The fundamental difference between the tandem and IOI architectures is where the four-color image is constructed. In a typical IOI architecture, the four-color image is constructed on one photoreceptor and transferred in a single step to a substrate. An example of a printer employing this architecture is the iGen3 series of marking engines made by Xerox Corporation. The multiple charge, expose and development steps on a single photoreceptor and the transfer of all four color toners in a single step offer advantages, while the complex system interactions resulting from such steps add complexities in control of the charge, development and exposure.

In tandem architectures, the IOI complexities are generally avoided by separating the process into multiple steps. In a typical tandem architecture, the four-color image is constructed either on paper or an intermediate transfer member. Each color toner is transferred separately from an individual photoreceptor to the paper substrate, either directly or through the intermediate member. Examples of tandem architecture included Xerox models DC250 and DC8000. While tandem architectures have fewer image-on-image type system interactions and the interactions are less severe, one has to manage multiple toner transfers and registration steps with a larger number of components. Tandem architectures thus generally require high speed motion control systems to reduce registration errors and other motion errors. Thus, there are advantages and disadvantages to each architectural system. For a more detailed explanation and comparison of such architectures, one can review a publication entitled "Is Image-On-Image Color Printing a Privileged Printing Architecture for Production Digital Printing Applications?" by Rick Lux et al., the disclosure of which is incorporated by reference herein in its entirety.

SUMMARY

In either technology, conventional xerographic marking devices have been built around a focused product application with component configurations tailored for a specific functionality. Such products render machine adaptations limited or unavailable. Thus, product lines covering monochrome, highlight color, four-color, phototone color, and extended gamut models typically shared little, if any, system components, particularly print engine components. This tended to increase product development costs, limit upgrade or reconfiguration options to meet new market demands, and created a servicing dilemma requiring large inventories of multiple differing parts to service multiple product lines.

Also, as the industry moves towards smoother color and higher quality, extended gamut and phototone applications have become increasingly popular. However, adding extra color capability increases the device footprint (product size) as extra print engine components, including photoreceptors and developers are required. Making smaller photoreceptor components can have an adverse effect on printer throughput and life expectancies of components. Thus, adding extra photoreceptors on tandem architectures for applications such as extended gamut printing or phototone printing may result in more complexity in motion control, toner image transfer interactions and an increased product footprint while an increase in the number of charge, development, and image exposure steps in an IOI photoreceptor will have an adverse effect on charge, development, and image exposure complexity. Thus, both conventional print technologies have neared the end of practical extension to new consumer demands.

In accordance with aspects of the disclosure, a two-color IOI drum marking module is provided, which can be used alone or in combination with other identical modules and optional accessories as an adaptable universal hybrid platform building block for achieving multiple different levels of functionality using common architectural features and components. The drum module transfers two-color image pairs in a single pass onto an intermediate transfer unit. This architecture offers extensibility and flexibility to provide configurations that may be customized to fit specific customer needs in color image quality and functionality.

The two-color IOI drum module offers the best attributes of IOI technology, while offering a compact and robust module to enable spot color printing, also known as highlight color printing. Using the present technology for spot color printing, black plus one color (K+1) developed images are formed on a single rotation of a photoreceptor drum to produce prints at benchmark run speed, costs, and image quality. In exemplary embodiments, the two-color IOI drum module provides a two-color pairing of marking material that can easily adapt to additional functionality, including a long life and/or higher speed monochrome printer using K+K colorants, a high quality monochrome printer using K+G (gray colorant), or high-gloss or matte photo finish functionality in the photographic market by combining MK+GK (matte black+gloss black), or K+CC (clear coat). Further, by combining two or more IOI drum modules, full color can be realized by duplication of the basic building block components. In addition, robust phototone printing is enabled, where phototone printing refers to use of conventional colorants, such as cyan, magenta, and black, plus one or more colorants possessing a similar hue to the conventional colorants, such as light cyan, light magenta, gray, white, light or dark yellow and clear. Extended gamut capabilities can also be realized by duplication of the basic building block components, where extended gamut printing entails forming colors from use of conventional colorants plus one or more colorants of a different hue, such as red, green, blue, violet, and orange. Alternatively, one or more of the colors may be other functional materials serving as specialty colorants, such as opaque white, MICR toner, metallic colorants, fluorescent colorants, and other colors or coatings.

Aspects of a two-color IOI drum module offers size and registration advantages to tandem architectures that use only a single color per photoreceptor and multiple transfers, while also reducing development, charge and image exposure control complexities of standard four-color IOI development on a single photoreceptor. Also, by limiting the IOI drum module to two-color pairings, the module becomes more universally adaptable to applications besides full color marking, including monochrome or highlight applications, phototone and extended gamut applications. Moreover, drum module components can be optimized for performance, life expectancy, footprint, cost, etc.

In exemplary embodiments, the two-color IOI drum module is housed in a "fixed space" housing sized to universally fit within a standardized platform xerographic marking device to reuse common transport, control and finishing components while providing substitutable marling engine modules that change the functionality of the device.

In exemplary embodiments, depending on the specific two-color pairings, different types of system components can be provided with little or no adverse effect and possible improved properties. For example, if the two-color pairings share a same hue (such as cyan and light cyan), contamination from downstream scavenging at a downstream development unit will have only negligible effect as any picked up marking material of the first color will be of the same hue as the second color. Thus, the type of development used is not as critical as in some other pairings. In view of this, other types of development can be used, including less efficient non-interactive development methods or even contact development methods. Also, if the two-color pairings are of substantially opposite hue, such as a magenta/green colorant pairing (or a dedicated spot color), it is less likely that both colors will be applied to the same location on the photoreceptor as part of the image. This can reduce interactions and exposure difficulties by preventing or limiting exposure through previously applied layers of toner.

In various embodiments, the two-color IOI drum module transfers both color pairings in a single pass onto an intermediate transfer unit, such as an intermediate drum or belt. This provides a stable and predictable transfer media, improves the speed of the system, allows for flexibility in system components, and can reduce complex system interactions. For example, because only a single transfer pass is used, the cleaning unit may be fixed in place. This avoids complexities in camming of cleaning units away from the photoreceptor required in multiple pass systems. Also, as no pre-existing marking material is applied from previous passes, the first charging unit and development unit can by contact type systems, increasing flexibility in system component usage.

In an exemplary embodiment, a modular xerographic marking device system is provided in which at least one modular xerographic marking device can be assembled from the following modular components: a common paper transport module containing paper path components that define a paper path through the modular xerographic marking device and convey a sheet of paper from a paper inlet to a paper outlet; an image output terminal cavity of fixed specified dimensions within the common paper transport module, the image output terminal cavity being exposed to a portion of the paper path; and two or more differently configured marking engines, each sized and configured to be provided and mounted within the image output terminal cavity of the common paper transport module to transfer marking material from the marking engine onto paper transported along the paper path. Each of the different marking engines includes at least one two-color IOI drum module including a) a first charging unit disposed along a rotatable photoconductive photoreceptor, wherein the first charging unit places a substantially uniform charge on the photoreceptor; b) a first exposure unit disposed along the photoreceptor downstream of the first charging unit, wherein the first exposure unit performs an image-wise exposure to the photoreceptor to produce a first latent electrostatic image on the photoreceptor; c) a first development unit disposed along the photoreceptor downstream of the first exposure unit, wherein the first development unit places a first marking material on the photoreceptor according to the first latent electrostatic image to produce a first toned image; d) a second charging unit disposed on the photoreceptor downstream of the first exposure unit, wherein the second charging unit places a substantially uniform charge on the photoreceptor; e) a second exposure unit disposed along the photoreceptor downstream of the second charging unit, wherein the second exposure unit performs an image-wise exposure to the photoreceptor to produce a second latent electrostatic image on the photoreceptor; and f) a second development unit disposed along the photoreceptor downstream of the second exposure unit, wherein the second development unit places a second marking material on the photoreceptor according to the second latent electrostatic image to produce a second toned image. Each of the at least one modular xerographic marking device is assembled from a combination of the common paper transport module and one of the marking engines mounted within the image output terminal cavity of the common paper transport module so that print media transported along the paper path can receive the first toned image and the second toned image from the photoreceptor from each two-color IOI drum module in a single transfer to produce a toned image on print media.

In various embodiments, the first exposure unit and the second exposure unit may share one or more optical elements, and toner within both the first and second development unit are of a same polarity.

In further embodiments, a xerographic marking device includes at least one two-color image-on-image (IOI) drum module wherein first and second marking material are of substantially opposite hue and define a two-color pairing of the two-color IOI drum module. In other embodiments, a xerographic marking device includes at least one two-color image-on-image (IOI) drum module wherein first and second marking material are of substantially the same hue and define a two-color pairing of the two-color IOI drum module.

BRIEF DESCRIPTION OF THE DRAWINGS

Exemplary embodiments will be described with reference to the attached drawings, in which like numerals represent like parts, and in which.

EMBODIMENTS

Embodiments of the disclosure are directed to an improved two-color Image-On-Image (IOI) drum module architecture and applications thereof. However, for a general understanding of the IOI technology from which such a module is based, reference will be made to FIGS. 1-15, which show the basic IOI architecture in a traditional IOI system, such as that used in the iGen3 product series from Xerox Corporation.

Figure 14:
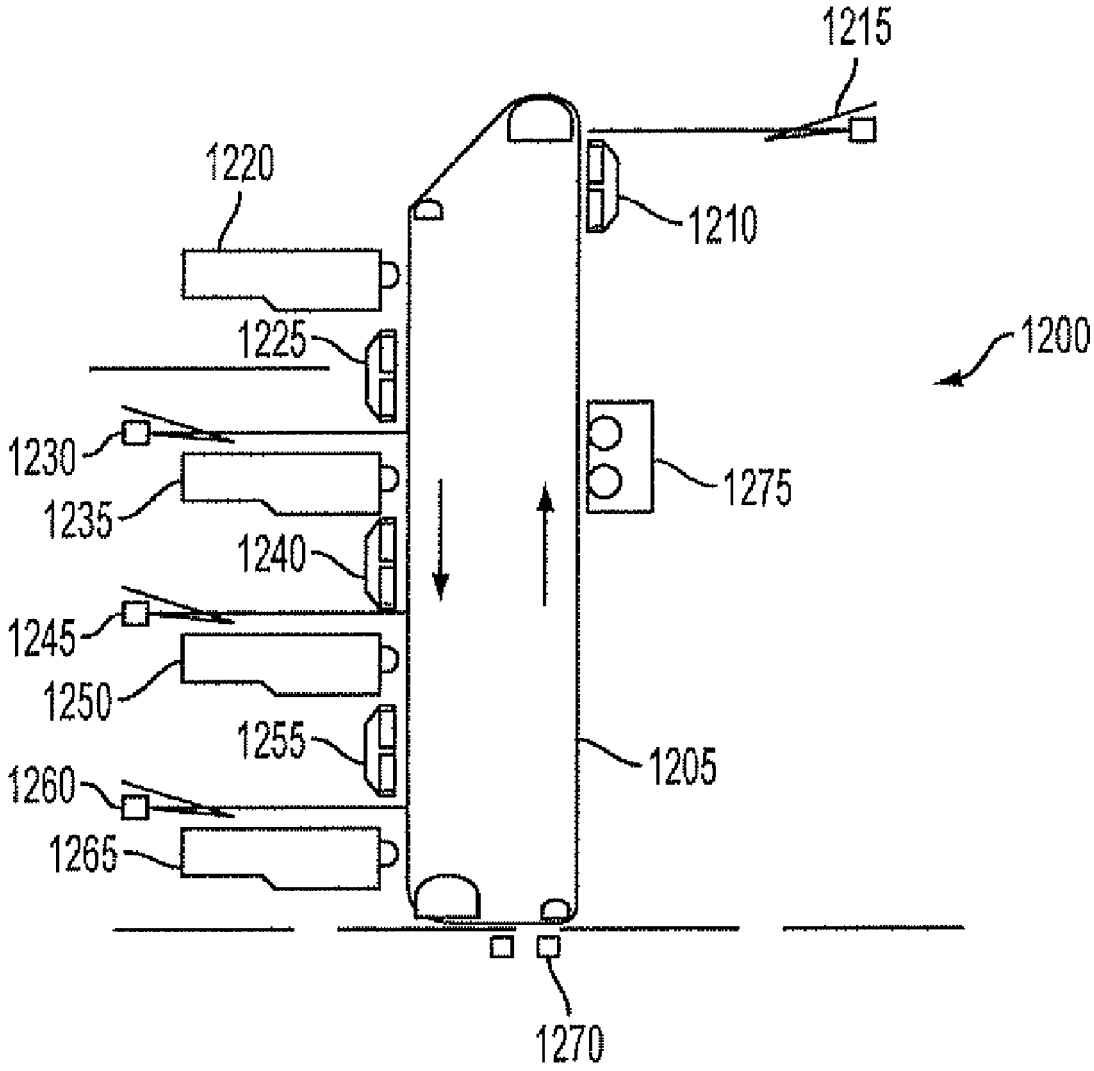
FIG. 14 RELATED ART
FIG. 14 illustrates a conventional Recharge, Expose And Develop (ReaD) Image-On-Image (IOI) architecture.

IOI technology is based on a Recharge, Expose, and Develop (REaD) process in which the color image, either a spot or process color, is built on a photoreceptor in a single pass as shown in FIG. 14. The built image is then transferred in a single step to a recording media such as paper. The IOI process can place toner of multiple colors on top of, as well as adjacent to, each other. A conventional full color (cyan, magenta, yellow, black—CMYK) xerographic engine would include four charge, image and non-interactive development systems in a development sequence typically in the order of Magenta, Yellow, Cyan and Black and one single transfer station. In particular, the IOI xerographic engine 1200 includes an photoreceptor belt 1205 (serving as a photoconductive surface and toner image transport means) upon which are oriented in a process direction a charging station 1210, a first laser exposure station 1215, a magenta development station 1220, a recharge station 1225, a second laser exposure station 1230, a yellow development station 1235, a second recharge station 1240, a third laser exposure station 1245, a cyan development station 1250, a third recharge station 1255, a fourth laser exposure station 1260, a black development station 1265, a transfer station 1270, and a cleaning station 1275.

The REaD IOI technology makes use of non-interactive powder cloud development to achieve desired image quality when building multiple images on a single photoreceptor surface. An example of non-interactive development (NID), also known as scavengeless development, can be found in U.S. Pat. Nos. 4,868,600 to Hays et al. and 5,032,872 to Folkins et al., both assigned to Xerox Corporation and incorporated herein by reference in their entireties.

Figure 15:
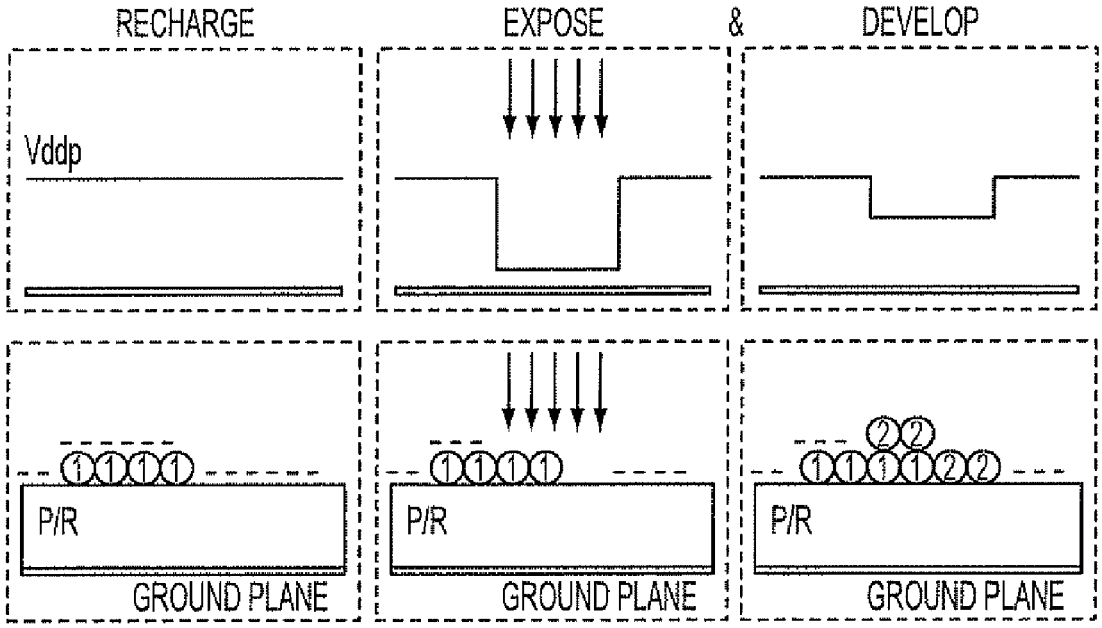
FIG. 15 RELATED ART
FIG. 15 illustrates conventional basic REaD electrostatic surface potentials to explain the IOI xerographic process.

General operation of REaD technology is illustrated in FIG. 15. After exposure and developing of a first color (magenta), the surface of the intermediate photoreceptor belt 1205 is recharged to a constant electrostatic potential (lower left side of FIG. 15). A next exposure by a subsequent laser exposure station exposes the belt 1205 to an electrostatic potential (lower middle of FIG. 15) to receive and develop a second color toner thereon (lower right side of FIG. 15). The second toner can then be placed alongside and on top of the underlying first toner as shown. The process continues for layers three and four. After development, all four layers are transferred at the same time at transfer station 1270 onto a recording media such as paper. Then, the photoreceptor surface of the belt 1205 passes cleaning station 1275 where residual toner is removed. The process may then be repeated starting with charging using charger 1210 and so forth to form other images.

However, because up to four layers may be applied on the photoreceptor belt 1205, substantial complexities exist due to the interactions resulting from multiple charge, exposure and development steps on a single photoreceptor prior to transfer. For example, imaging through multiple layers of the toner complicates exposure by having to image through a variable thickness consisting of bare photoreceptor surface or one or more previously developed toner layers. Also, because of the previously applied toner layers, downstream development may require tight control.

Figure 1:
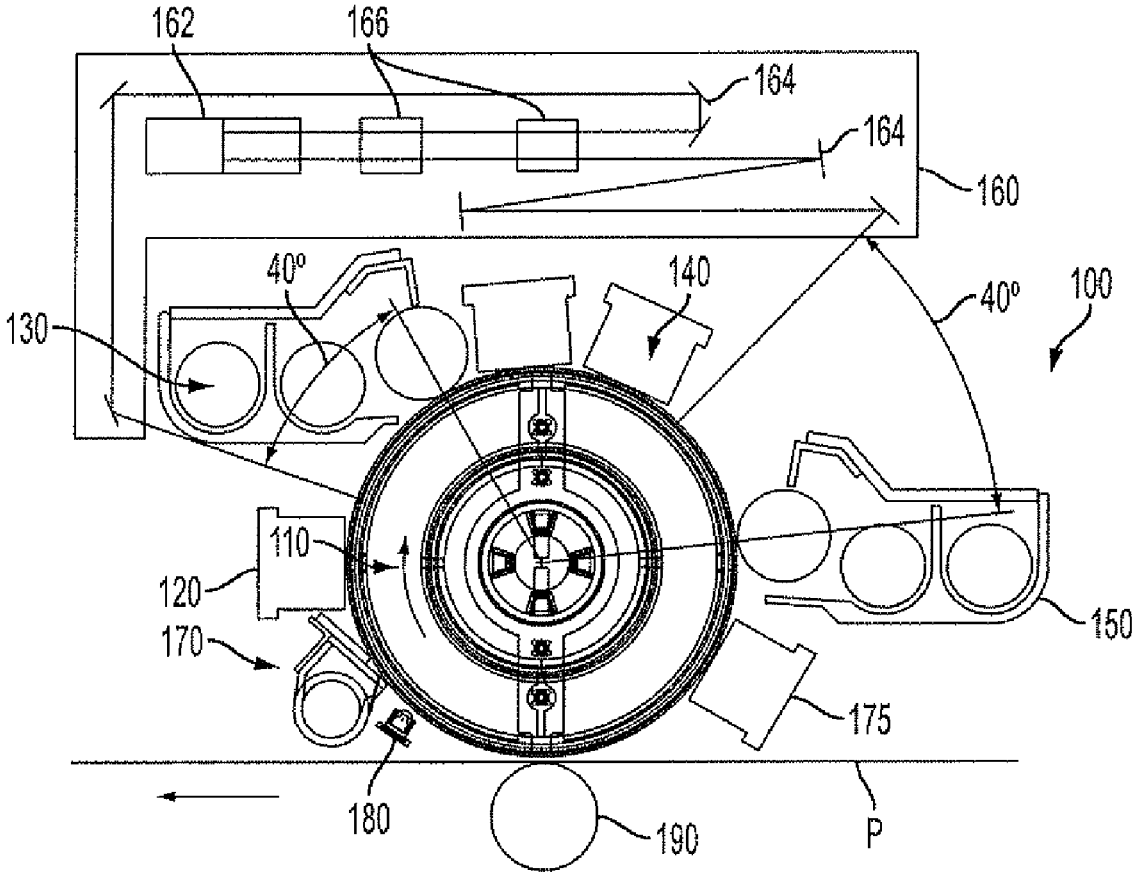
FIG. 1 is an exemplary two-color Image-On-Image (IOI) drum module architecture suitable for use as a replaceable module component in a product line of xerographic products that can meet varying reproduction/copying/marking needs.

An improved xerographic architecture is provided by aspects of this disclosure and includes a two-color IOI drum module 100 shown in FIG. 1. In this embodiment, system components are tightly provided around a suitably sized photoreceptor drum 110, for example, of at least about 80 mm or more to achieve desirable process speeds. A reduced drum size may be enabled at low process speeds and with reduced subsystem components. In an exemplary embodiment, drum 110 is an 84 mm drum, which is suitably sized to achieve a reduced footprint, relatively high print speeds of about 100 ppm, and sufficient circumferential surface area to accommodate necessary system components.

Provided in a process direction on the drum 110 are a first charging unit 120, a first development unit 130, a second charging unit (recharge) 140, a second development unit 150, typically of a non-interactive development type (scavengeless development), and a cleaning unit 170. A pre-transfer unit 175 may optionally be located after the second development unit and an erase lamp 180 may be provided before the cleaning unit 170. A Raster Output Scanner (ROS) 160, such as a 2-channel laser 162 and a series of mirrors 164 and common optics 166, is also provided, preferably above the drum to minimize the module footprint. A 2-channel laser ROS writes more than one channel and shares some, but not all, components across the more than one channel.

An intermediate transfer unit 190 is provided that transfers the developed images in a single transfer onto a media sheet, such as paper P. In an illustrated embodiment, the intermediate transfer unit is a transfer drum, but could take other forms. The intermediate transfer unit 190 may be part of the drum module 100 itself or may be an integrated part of a xerographic device that mates with the drum module 100. In an alternative embodiment, an intermediate transfer belt may be provided upon which the developed images are initially transferred in a single transfer step. The transferred image may then subsequently be transferred onto the media sheet.

Two-color pairings of marking material on each photoreceptor drum of the IOI drum module provide excellent color-to-color registration afforded by factors, such as rigidity of the photoreceptor drum and a stable, predictable photoreceptor drum surface velocity. Suitably sized components are provided around the perimeter of the photoreceptor drum 110.

ROS 160 serves as both a first exposure unit and a second exposure unit in which common optics are shared for the two exposure processes performed on each drum module. The first exposure unit produces a first latent electrostatic image on the photoreceptor drum 110 in a first exposure zone located downstream of the first charging unit 120 between the first charging unit 120 and the first development unit 130. The latent image information is carried through the common optics 166 past one or more of the mirrors 164 onto the photoreceptor drum. The second exposure unit produces a second latent electrostatic image on the photoreceptor drum 110 in a second exposure zone located downstream of the second charging unit (recharge) 140 between the second charging unit 140 and the second development unit 150 as shown. In an illustrated embodiment, each exposure unit is positioned to provide a 40° exposure to development zone. In other embodiments, two individual ROS units, an LED bar or image bar may be provided as the exposure unit. Each type may occupy different space around the periphery of the drum, with the ROS unit requiring the least amount of space because it only requires a path for the flying spot versus close proximity of an LED bar w/selfoc lens assembly.

In exemplary embodiments, the marking material in the first and second developer is toner of a same polarity so as to achieve image-on-image functionality to the drum module. In certain applications, known small EA toner of 3-5 micron size is used to ensure high image quality with reduced IOI interactions and with reduced run cost.

As stated earlier, several complex system interactions are unique to the IOI process and have to be managed to produce quality images. As successive toner layers are built up on the photoreceptor surface, they can affect the subsequent latent image uniformity due to toner layer residual voltage, increased dielectric thickness and exposure loss by imaging through multiple layers. It has been found that a split-AC recharge system formed of AC and DC charge devices is beneficial to charge the toned layers and photoreceptor uniformly for the next exposure and development.

In various embodiments, the charging units may all be high efficiency, non-contact, low ozone chargers to minimize waterfront and achieve uniform charging. A charging unit suitable for charge, recharge and pre-transfer may be similar to those found in Xerox's DC 250 xerographic device. Known chargers are capable of achieving a high slope charge of about 1.8 μA/V/m with a minimal waterfront of about 10 mm. However, depending on specific color pairings in the drum module, other charger types, of non-contact or contact type, may be provided, such as a scorotron. For example, AC/DC split recharge may not be necessary, and a pre-transfer charging unit may be omitted. Also, a bias charge roll charging unit may be used for charging unit 120, accommodating high charging efficiency with good uniformity and reduced photoreceptor waterfront.

A split-AC recharge system can be seen, for example, in U.S. Pat. No. 5,606,430 to Folkins et al., assigned to Xerox Corporation and incorporated by reference herein in its entirety. In embodiments, recharge unit 140 may be a split-AC recharge device. Alternately, to minimize photoreceptor waterfront and to optimally control the toner layers on the photoreceptor, we may select a single charge device—such as DC only recharge—as two-color IOI presents reduced sensitivity to charging uniformity with typically less toner mass.

In various embodiments, the development units are non-contact, non-interactive development (NID) units that provide gentle development to enable image-on-image development of two colors per drum in a single pass. Suitable development processes in certain applications may include hybrid scavengeless development, low impact magnetic brush development, hybrid jumping development or magnetic agitation zone development. Depending on the size of the photoreceptor drum, sizing and proportions of the development units may require modification to tightly fit around the drum periphery. For example, horizontal center-to-center distance between an auger and developer roll of the development unit may be decreased.

The NID development should be carefully tuned to reduce contamination in the development housing and in the imaged area on the photoreceptor surface by the different color toners. Such contamination can cause color shift by removal of prior separation layers or scavenging of toner particles from the photoreceptor surface into a developer housing of a downstream developer of a different color. Therefore, several operating parameters should be tightly controlled, particularly for obtaining four-color imaging on a photoreceptor surface.

However, in certain applications, requirements for a scavengeless or ND development unit may be reduced, allowing substitution of alternate development units. For example, the upstream first development unit 130 can be a contact type (interactive) developer, such as a contact brush development unit, because there are no previously built up layers in a single pass system. Contact development may have certain advantages, such as resolution, if adverse effects are reduced. Also, depending on particular color pairings in each module, lesser control may be acceptable. For example, if the second development unit 150 houses a second type marking material of substantially the same hue as the first type marking material, contamination effect due to interaction would be minimal. In such an application, interactive development may be implemented with minimal adverse effect and possible improved imaging properties. For example, light cyan, light magenta, and light black (gray), etc. could be used as the second type marking material when the first type is cyan, magenta, and black, respectively. Additionally, a lighter or darker yellow, white or clear may be paired with yellow with minimal adverse effects.

In exemplary embodiments, cleaning unit 170 may be in the form of a blade cleaner with a waste auger. Alternatively, a single electrostatic brush cleaning unit may also be used and occupy about the same amount of waterfront on the periphery of the IOI drum module.

In exemplary embodiments, multiple two-color IOI drum modules are provided about an intermediate transfer belt/drum to form a xerographic device that combines IOI and tandem architectures. In certain embodiments, color combinations for extended gamut applications using the two-color module are described. For example, it can be desirable to put toners of substantially opposite hue in the pair. In such a case, the toners will tend to not both be present at the same spot on the photoreceptor. This greatly simplifies IOI management and the tandem transfer process with single layer transfer. That is, there will only be toner next to toner, not toner on toner. Suitable examples of substantially opposite hue color pairings include cyan+red, cyan+orange, magenta+green, yellow+blue, yellow+violet, etc. Specialty colors, such as spot colors, etc. not typically applied in a same location as other marking materials can also be considered as being of substantially an opposite hue.

In other embodiments, color combinations for phototone applications using the two-color module are provided. For example, toners of the same hue can be placed in the IOI pair. In such a case, contamination in the second development station from scavenging will not produce a dirty, noisy appearance as the colors are of a same hue. An example would be cyan+light cyan, magenta+light magenta, yellow+dark yellow, etc.

Halftoning methods for extended gamut and phototone applications are also described. For extended gamut applications, one could use the same halftone pattern for two colors in a pair if they have substantially the opposite hue as above. Since the toners will tend to not both be present at the same spot on the photoreceptor, there is no need to design a halftone for each color that will not form an interference pattern with the halftone of the other color. For phototone printing, one could take advantage of the tight registration within an IOI pair. In such a case, dot-off-dot printing with screens of the same angle and frequency could be used, but offset to phase them dot-off-dot. An advantage is that this can reduce high mass points associated with toner on toner (again an advantaged situation for the transfer process). Dot-off-dot halftones are notoriously sensitive to misregistration, producing a large color shift for small amounts of color image shift. Color shift as a function of misregistration is analyzed in "Misregistration Sensitivity in Clustered Dot Halftones," B. Oztan, G. Sharma, R. Loce, *Journal of Electronic Imaging* 17(2), 023004 (April-June 2008). However, two-color pairings of marking material on each photoreceptor drum of the IOI drum module provide excellent color-to-color registration afforded by factors, such as rigidity of the photoreceptor drum and a stable, predictable photoreceptor drum surface velocity. Therefore, color shift between the pair has minimal impact because registration is very tight within such a pair.

Figure 2:
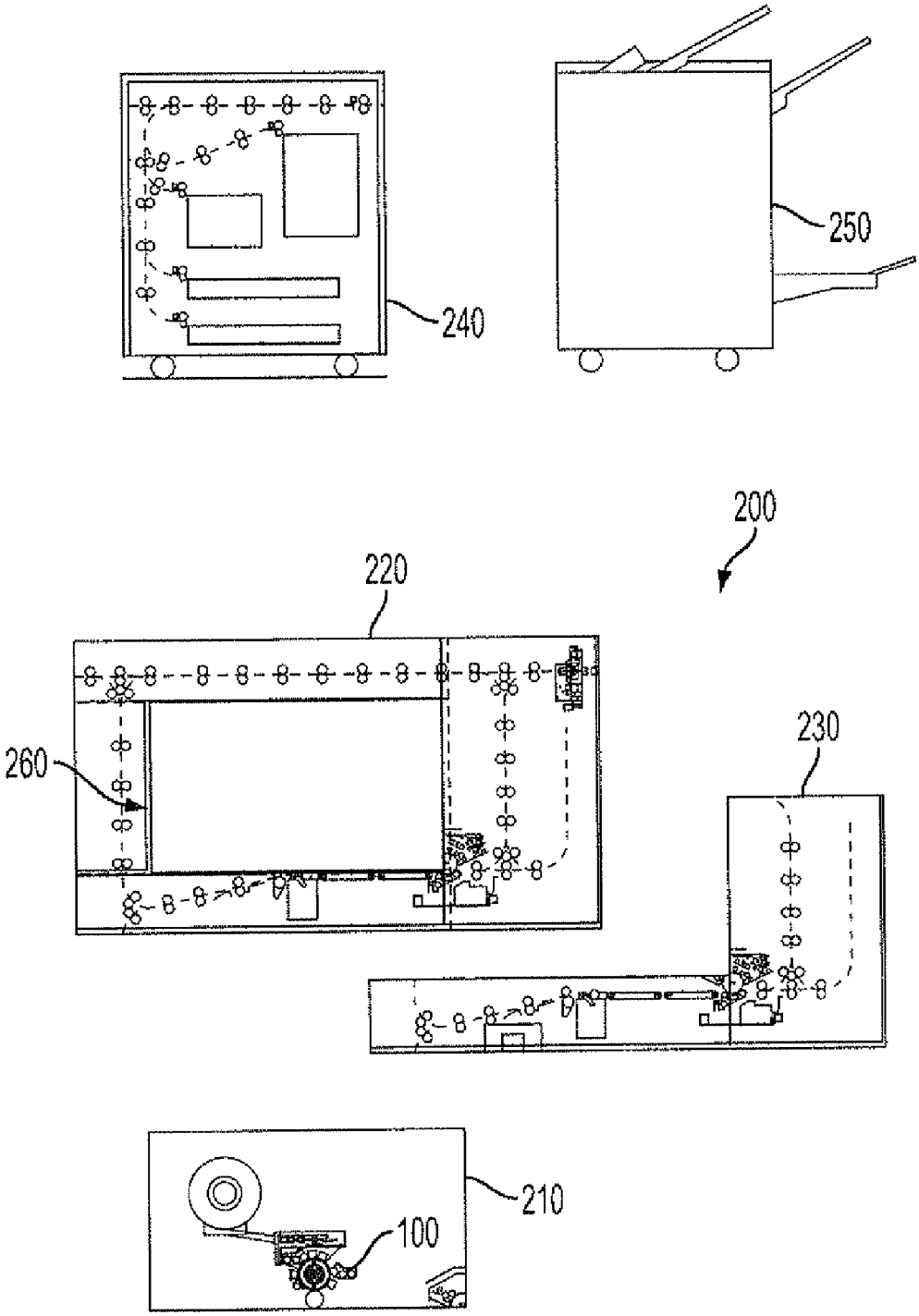
FIG. 2 illustrates exemplary components of a modular hybrid xerographic marking device, including a two-color IOI marking module.

In certain embodiments, the two-color IOI drum module is part of a modular hybrid xerographic marking device 200 and contained within a "fixed space" image output terminal (IOT) cavity 260 of specified dimensions as shown in FIG. 2. Marking engine 210 contains one of several different module configurations formed from one or more universal two-color IOI drum modules, such as the one shown in FIG. 1, and other optional components.

In an exemplary embodiment, modular xerographic marking device 200 includes a main paper transport module 220 containing paper path components and associated elements, a decurler module 230, a first type finishing module 240, and a second type finishing module 250. However, more or fewer module components may be provided that accommodate and receive modular fixed space IOT cavity 260 containing at least one two-color IOI drum module 100.

Figure 3:
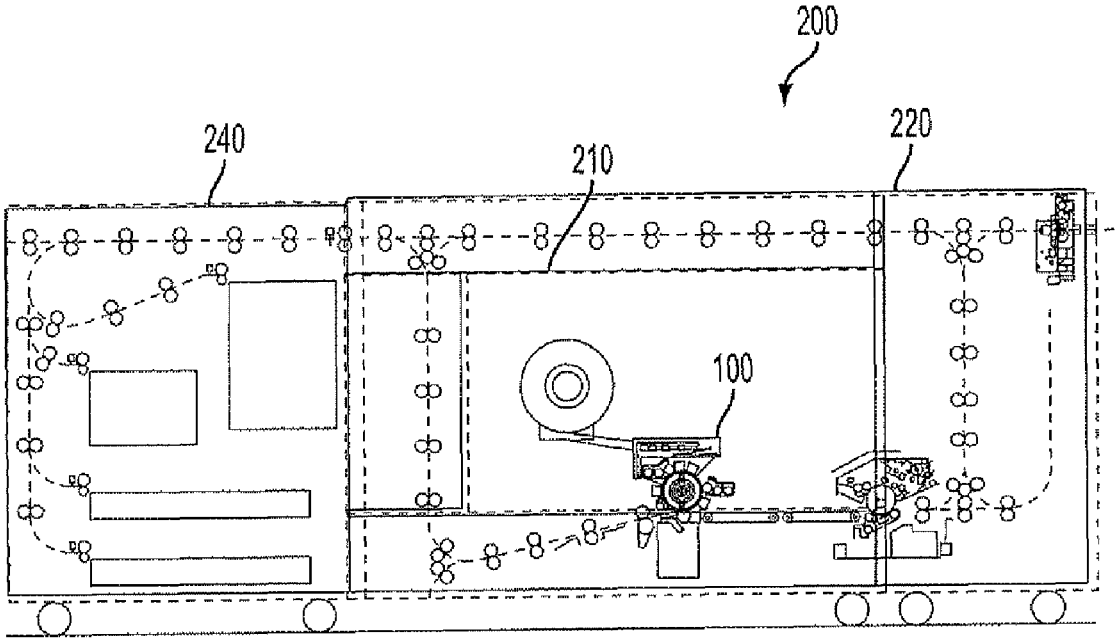
FIG. 3 illustrates a first highlight-color-capable marking configuration of the modular xerographic marking device.
Figure 4:
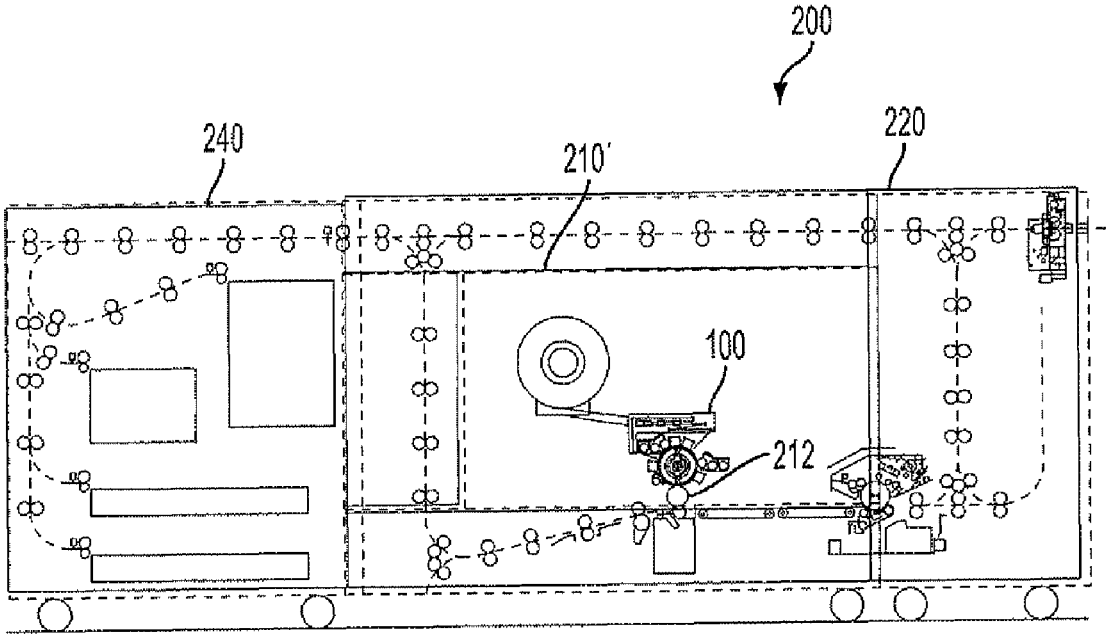
FIG. 4 illustrates a second highlight-color-capable marking configuration of the modular xerographic marking device incorporating the IOI marking module of FIG. 2.

FIG. 3 illustrates a modular hybrid xerographic marking engine including a single two-color IOI drum module 100 that enables high speed monochrome (K+K), or matte black+gloss black (MK+GK), or monochrome plus highlight (K+1), MICR (K+MICR), clear coat (K+CC) or gray (K+G) second color functionality. With the exemplary 84 mm photoreceptor drum diameter, this embodiment can achieve about 100 ppm output applying commonly available drum photoreceptors and subsystem components. In this embodiment, the photoreceptor directly transfers the image onto a media sheet, such as paper, transported by paper transport module 220. In a second embodiment shown in FIG. 4, a different marking engine 210' can include the same two-color IOI drum module coupled with an intermediate transfer drum 212. This embodiment enables commonality with conventional four- and six-color tandem engines and similarly produces high-speed monochrome or monochrome plus highlight, MICR, clear coat, gloss or gray second color functionality.

Figure 5:
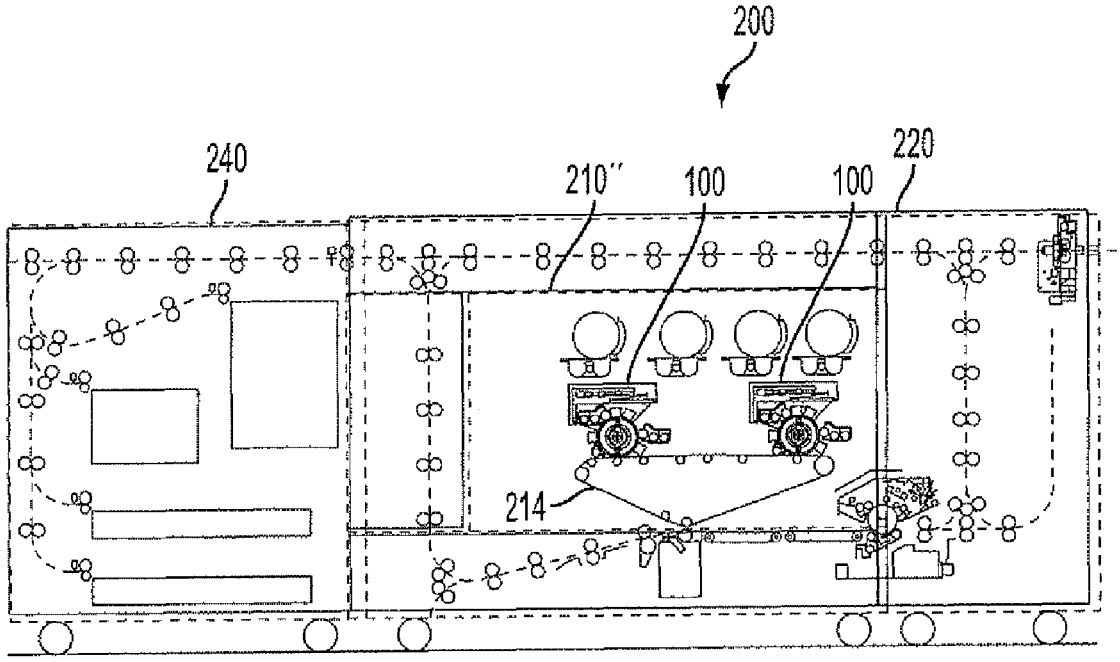
FIG. 5 illustrates a first full-color-capable-marking configuration of the modular xerographic marking device incorporating two IOI marking modules of FIG. 2.
Figure 6:
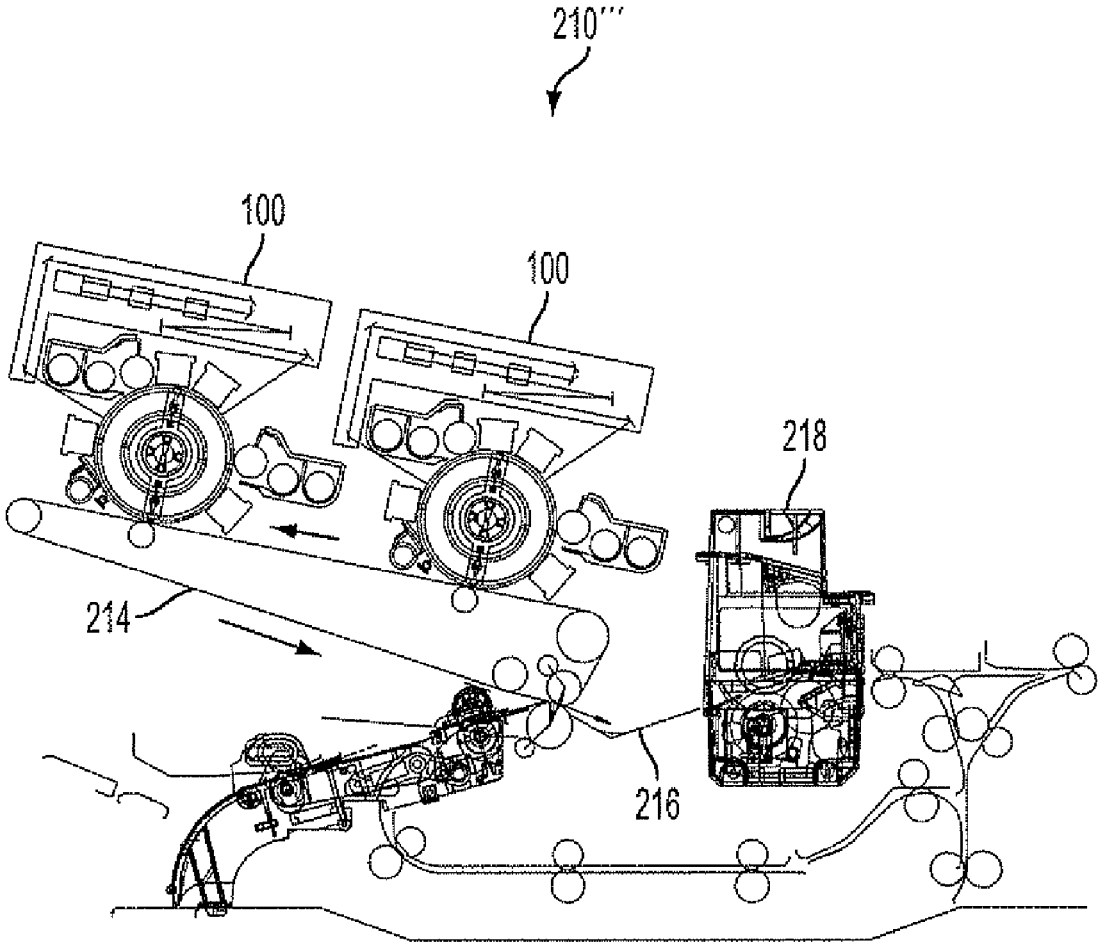
FIG. 6 illustrates a second full-color-capable-marking configuration of the modular xerographic marking device incorporating two IOI marking modules of FIG. 2.

FIG. 5 illustrates a modular hybrid xerographic marking engine 210" including a full-color-capable two-color IOI drum module is provided that contains a pair of individual two-color IOI drum modules 100, each of which is provided with two different colors. Typically, this would provide four total colors of CYMK. In this embodiment, both two-color IOI drum modules 100 are provided about an intermediate transfer belt 214 that transfers the images onto a paper media fed by the common paper transport. Because four colors can be achieved with only two marking modules 100, the footprint of the print engine is quite small compared to a tandem architecture with four photoreceptors. Plus, because the two-color IOI drum modules 100 are universal, simple added functionality can be achieved without a redesign of all system components Another full color marking engine 210'" that can be housed within an IOT cavity is shown in FIG. 6. In this embodiment, two two-color IOI drum modules 100 are provided on an intermediate transfer belt 214, which is coupled with an auxiliary paper path 216 that feeds the transferred media past a fuser 218.

Figure 7:
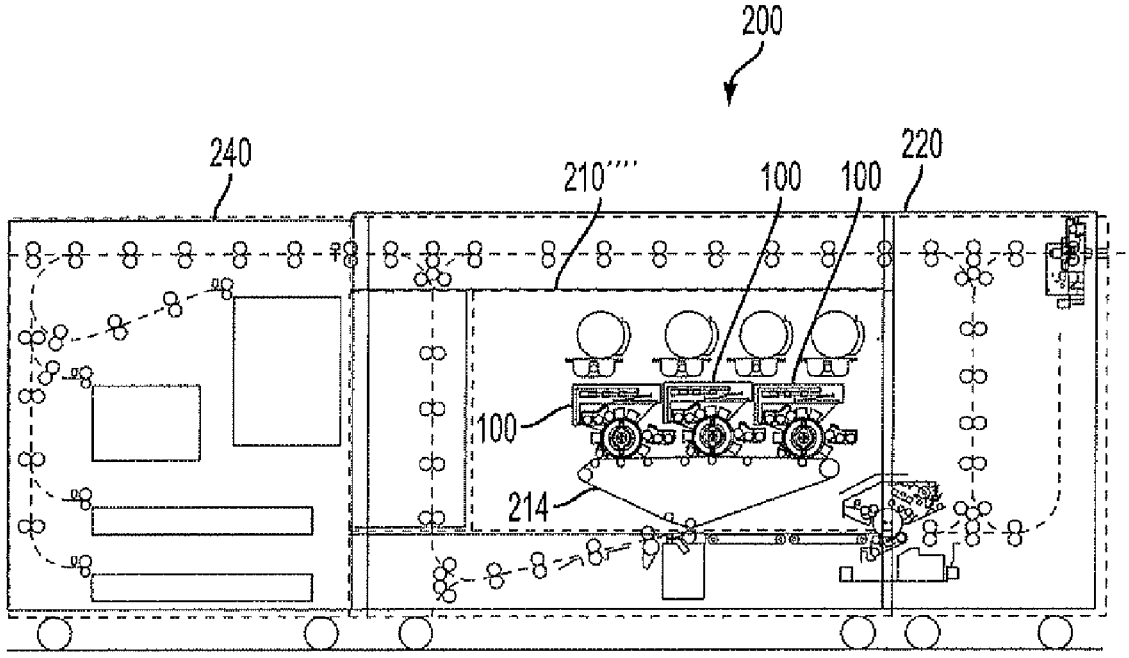
FIG. 7 illustrates a first extended-gamut-capable marking configuration of the modular xerographic marking device incorporating three IOI marking modules of FIG. 2 enabling six-color capability.
Figure 8:
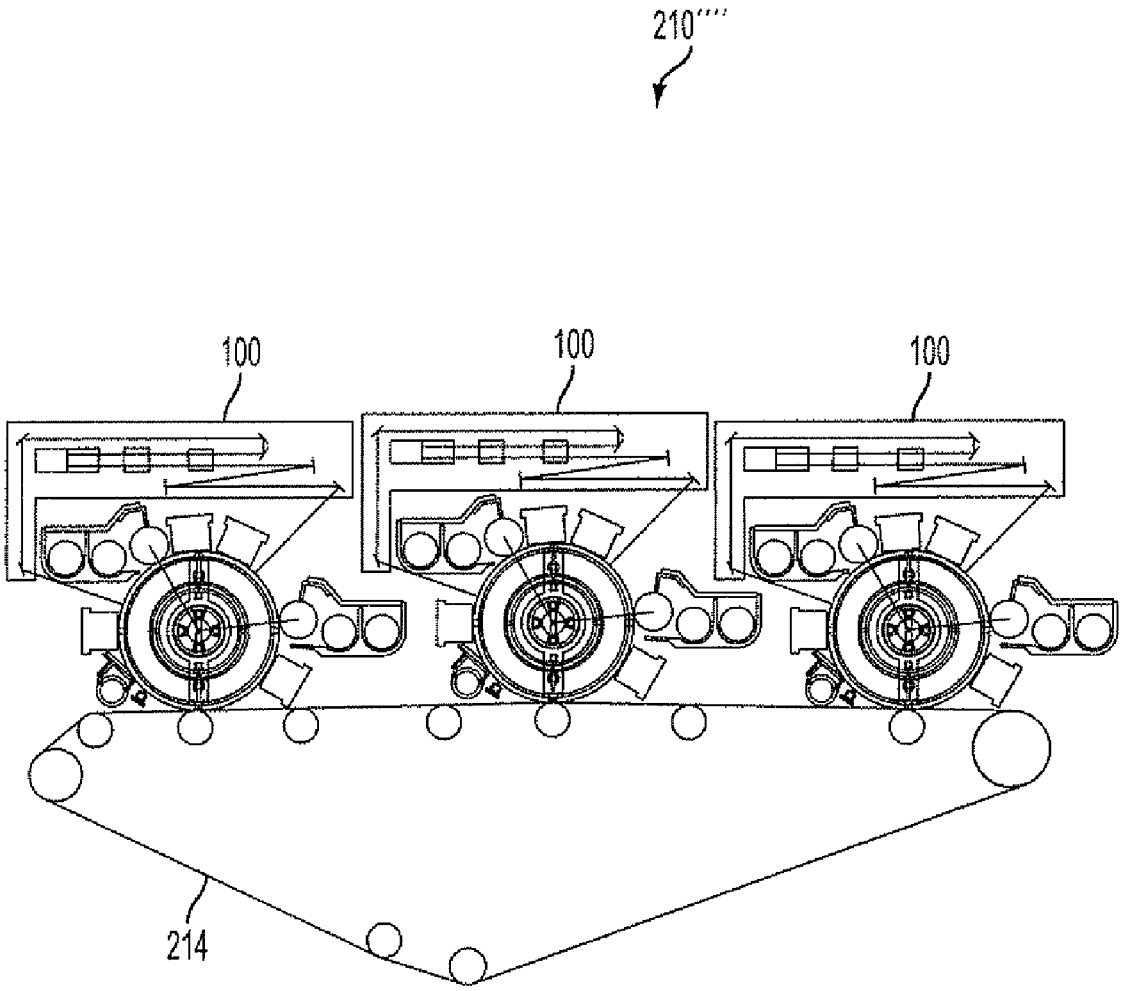
FIG. 8 illustrates a closeup of the six-color marking module of FIG. 7.

An embodiment of an extended gamut six-color print engine is shown in FIG. 7. In this embodiment, three two-color IOI drum modules 100 are provided in a marking engine 210"". Although this could be achieved using a different intermediate belt 214 from the embodiment of FIG. 5, the belt in FIG. 5 could be made of a common size with that of FIG. 7 so that both embodiments use the same intermediate transfer belt for increased commonality among product line variations. Thus, either two or three two-color IOI drum modules 100 are mountable on the belt 214 as better shown in FIG. 8.

Figure 9:
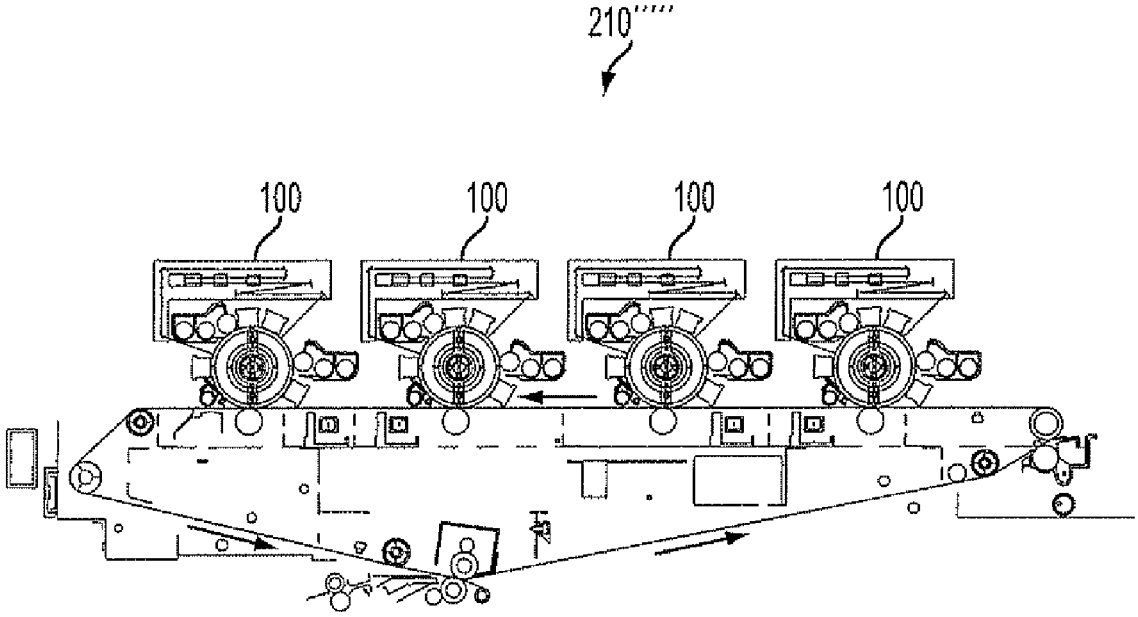
FIG. 9 illustrates a second extended-gamut-color-capable marking configuration of the modular xerographic marking device incorporating four IOI marking modules of FIG. 2 enabling eight-color capability.
Figure 10:
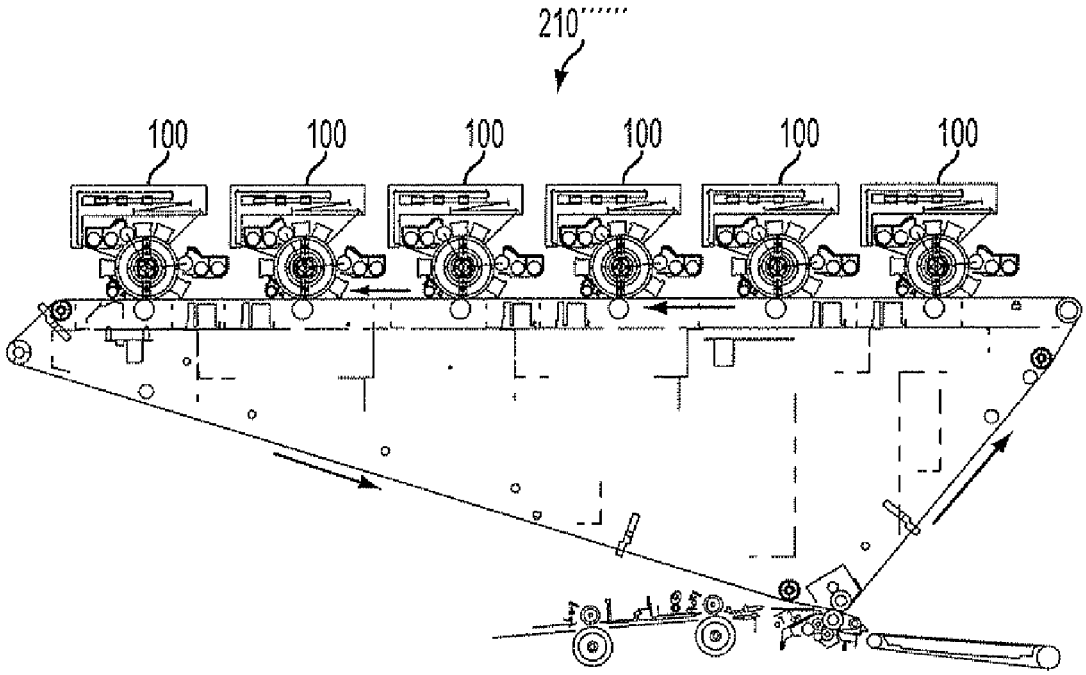
FIG. 10 illustrates a third extended-gamut-color-capable marking configuration of the modular xerographic marking device incorporating six IOI marking modules of FIG. 2 enabling up to 12-color capability.

Further expansion of functionality is readily available by adding more two-color IOI drum modules 100 as shown, for example, in embodiments of FIGS. 9 and 10. In FIG. 9, four two-color IOI drum modules 100 are shown, each providing two separate colors for a total of eight-color capability. In FIG. 10, six two-color IOI drum modules 100 are shown, each providing two separate colors for a total of 12-color capability.

Figure 11:
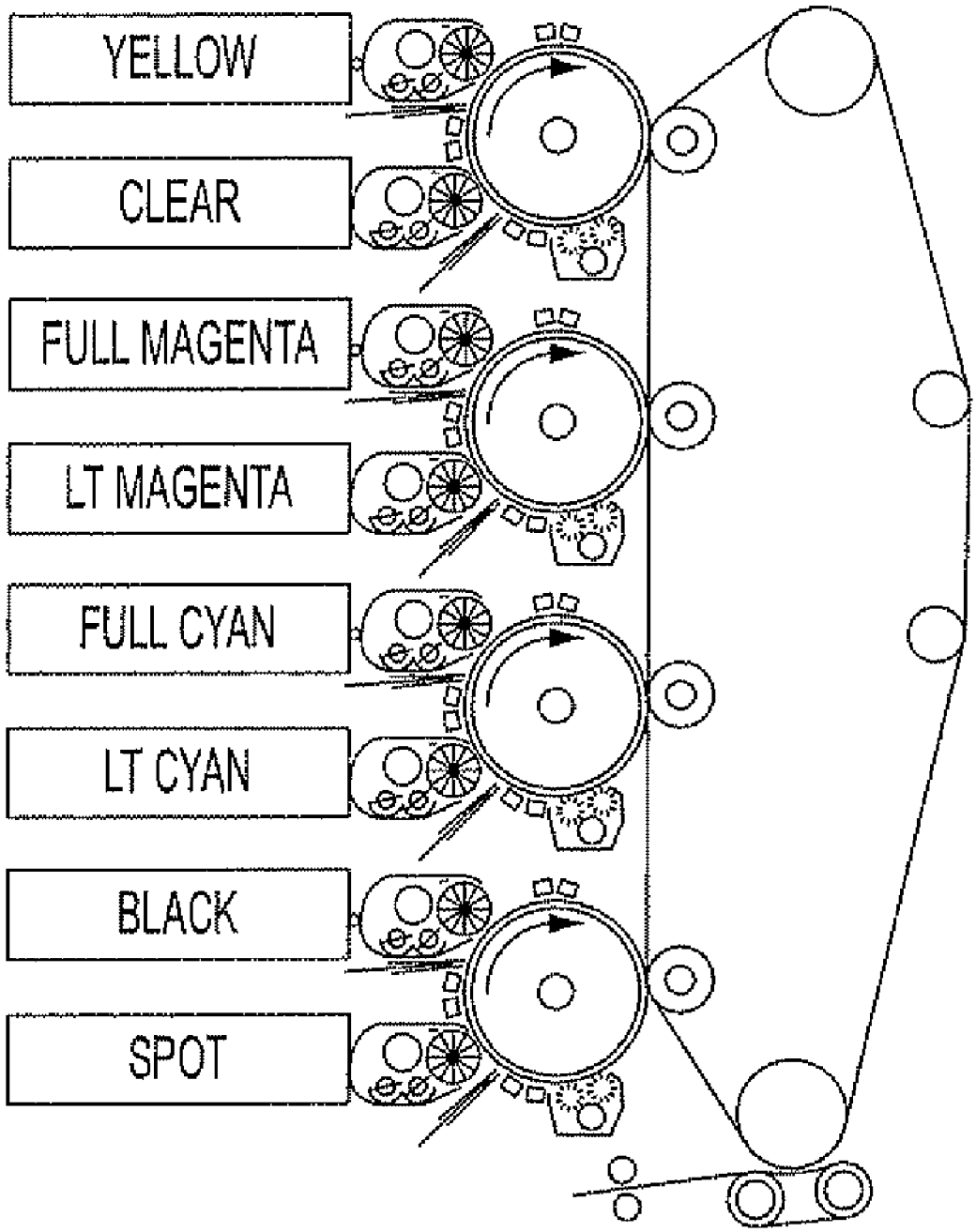
FIGS. 11-12 illustrate two examples of specific two pair coloring options in which each color pair has substantially the same hue.
Figure 12:
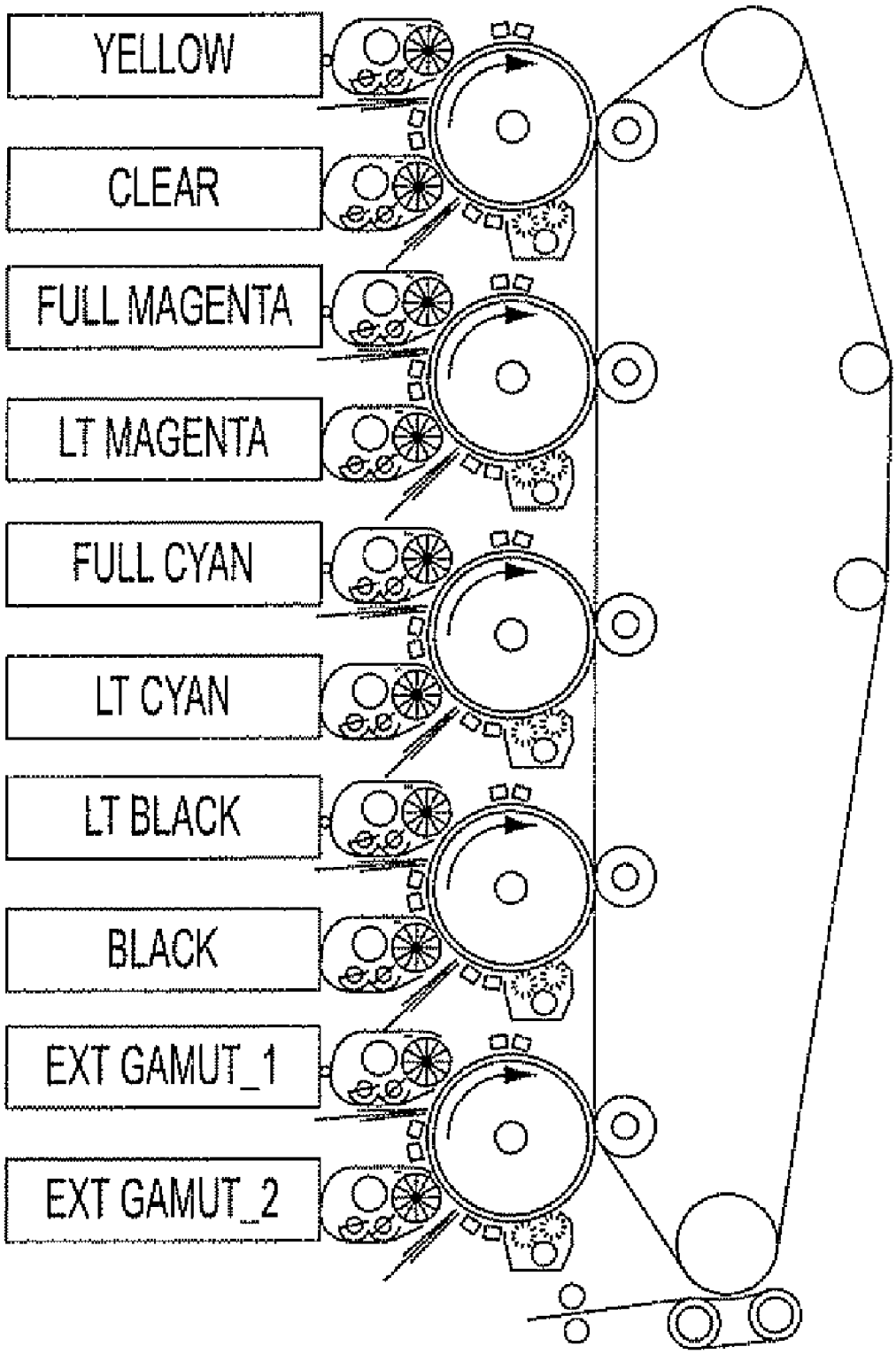

In phototone applications, specific color pairings may improve system operation, reduce control complexities, and improve image quality. FIGS. 11-12 show different two-color pairings of substantially the same hue that may be provided. These are particularly suitable combinations for phototone applications. An example would be cyan+light cyan, magenta+light magenta, etc. Yellow may suitably be paired with another form of yellow, clear or white marking material and achieve similar benefits. With such pairings, contamination in the second development station from scavenging will not produce a dirty, noisy appearance as the colors are of substantially a same hue. Also, use of light colorant improves image quality and consistency. In embodiments, full strength toner may be achieved with 5% pigment loading while reduced strength or light toner may be achieved with 1% pigment loading. Imaging may then be adjusted within area coverage to minimize noise, maximize tone reproduction curve (TRC) smoothness, maximize gray level stability and extend halftone options.

In the embodiments illustrated, color process order is intentional and minimizes contamination effect. For example, by applying light colorant first, any contamination that could occur into the downstream full strength colorant would pose a minimal impact. However, if the process order was reversed, full strength toner contamination in the light colorant would have more substantial impact on image quality. As shown, pairings of yellow with clear or black with spot colors would have a similar effect and pose minimal impact.

Obviously, these color selections are architecture configurations shown are only examples, and can be expanded upon.

Figure 13:
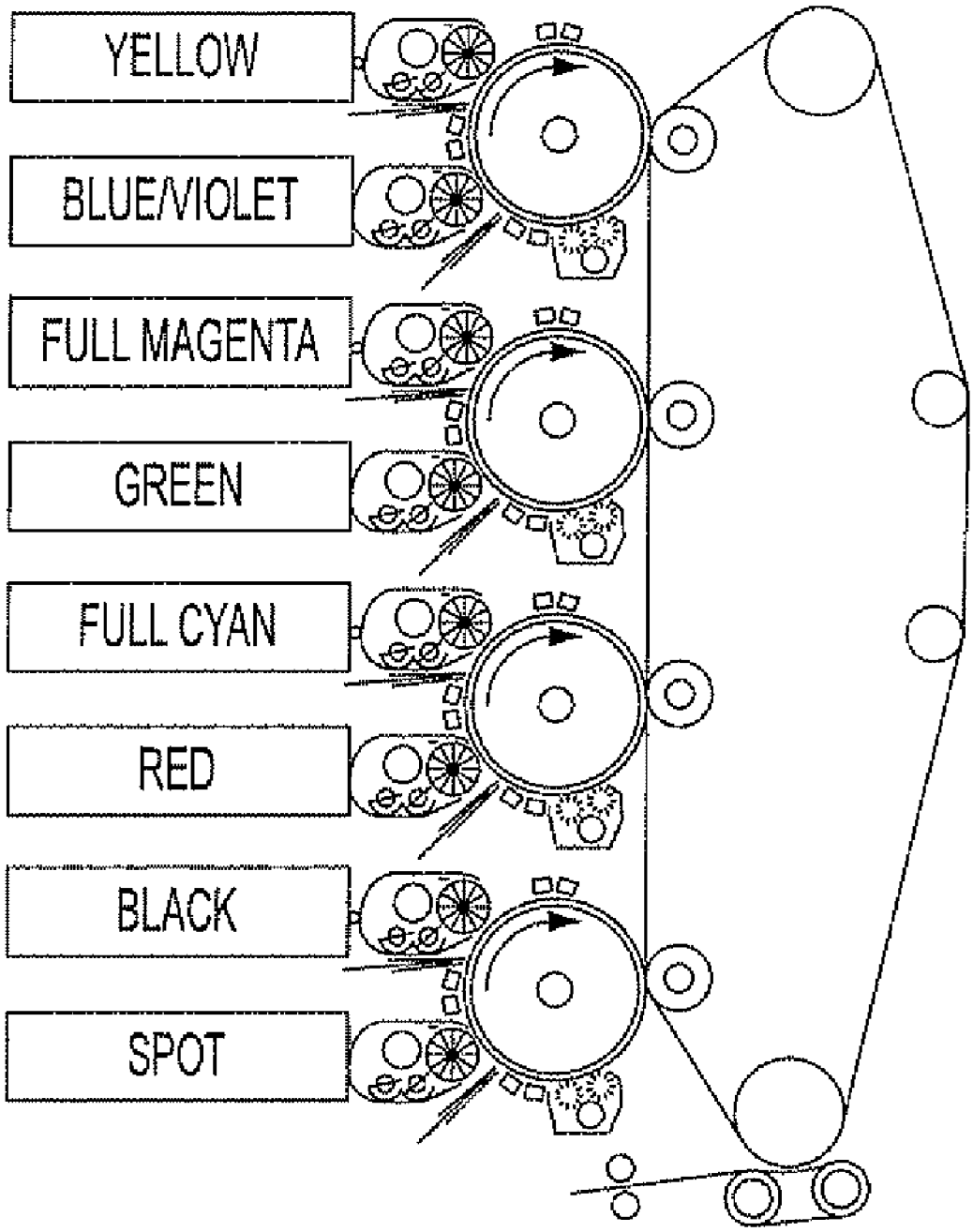
FIG. 13 illustrates an example of specific two pair coloring options in which each color pair has substantially opposite color hue.

Specific color pairings may also improve system operation, reduce control complexities, and improve image quality in extended gamut applications. Alternatively, as shown in FIG. 13, different two-color pairings of substantially opposite hue may be provided in extended gamut applications. In such a case, the toners will tend to not both be present at the same spot on the photoreceptor. This greatly simplifies IOI management and the tandem transfer process with single layer transfer. That is, there will only be toner next to toner, not toner on toner. Suitable examples of substantially opposite hue color pairings include cyan+red, cyan+orange, magenta+green, yellow+blue, yellow+violet, etc. Specialty colors, such as spot colors, etc. not typically applied in a same location as other marking materials can also be considered as being of substantially an opposite hue.

Expansion to differing functionality and increase in color selection is readily achievable with minimal change in operation or complexity. However, it may be necessary to provide larger intermediate transfer belts as the module 100 increases in number. Although not necessary, as can be seen from FIGS. 5-10, such two-color IOI drum modules can be used with existing product platform transfer mechanisms provided in DC 250 and DC 8000 products manufactured by Xerox Corporation.

By suitable sizing of the "fixed space" housing 260, each of these specific configurations may be made to fit the marking engine within the space of the xerographic marking device 200 and arranged to operate with other xerographic marking device modules, such as proper mating with the paper transport path so that simple substitution of drum module housing 260 allows for a change in device functionality.

Additionally, in accordance with various aspects of the disclosure, a user may be able to select not to use all colors present. In this situation, process control would deactivate various subcomponents of the drum modules. This can be achieved without modifying the overall operation of the device. For example, in the architecture of FIG. 11 or 12, if clear toner was not to be applied for a given print job, the corresponding charging unit, development unit and ROS exposure unit associated with the clear toner are simply powered off. Because the development units and charging units in certain applications are non-contact, this will not alter properties of the photoreceptor drum or other downstream processes, including timing of transfer. Similarly, because there is only a single pass of the drum, there is no need for "camming" components that cam to a disengaged position, such as movable cleaning units required on multiple pass systems.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A modular xerographic marking device system, comprising at least one modular xerographic marking device assembled from the following modular components:

a common paper transport module containing paper path components that define a paper path through the modular xerographic marking device and convey a sheet of paper from a paper inlet to a paper outlet;

an image output terminal cavity of fixed specified dimensions within the common paper transport module, the image output terminal cavity being exposed to a portion of the paper path; and two or more differently configured marking engines, each sized and configured to be provided and mounted within the image output terminal cavity of the common paper transport module to transfer marking material from the marking engine onto paper transported along the paper path, each of the different marking engines including at least one two-color IOI drum module including a) a first charging unit disposed along a rotatable photoconductive photoreceptor, wherein the first charging unit places a substantially uniform charge on the photoreceptor;

b) a first exposure unit disposed along the photoreceptor downstream of the first charging unit, wherein the first exposure unit performs an image-wise exposure to the photoreceptor to produce a first latent electrostatic image on the photoreceptor;

c) a first development unit disposed along the photoreceptor downstream of the first exposure unit, wherein the first development unit places a first marking material on the photoreceptor according to the first latent electrostatic image to produce a first toned image;

d) a second charging unit disposed on the photoreceptor downstream of the first exposure unit, wherein the second charging unit places a substantially uniform charge on the photoreceptor;

e) a second exposure unit disposed along the photoreceptor downstream of the second charging unit, wherein the second exposure unit performs an image-wise exposure to the photoreceptor to produce a second latent electrostatic image on the photoreceptor; and f) a second development unit disposed along the photoreceptor downstream of the second exposure unit, wherein the second development unit places a second marking material on the photoreceptor according to the second latent electrostatic image to produce a second toned image, wherein each of the at least one modular xerographic marking device is assembled from a combination of the common paper transport module and one of the marking engines mounted within the image output terminal cavity of the common paper transport module so that print media transported along the paper path can receive the first toned image and the second toned image from the photoreceptor from each two-color IOI drum module in a single transfer to produce a toned image on print media.

2. The xerographic marking device system of claim 1, wherein one of the two or more differently configured marking engines includes a single two-color IOI drum module.

3. The xerographic marking device system of claim 2, wherein at least one of the marking engines enables one of high speed monochrome (K+K), matte black+gloss black (MK+GK), monochrome+highlight (K+1), monochrome+MICR (K+MICR), monochrome+clear coat (K+CC) and monochrome+gray (K+G) color functionality.

4. The xerographic marking device system of claim 2, wherein another of the two or more differently configured marking engines includes two, two-color IOI drum modules and achieves full color marking capability.

5. The xerographic marking device system of claim 1, wherein one of the two or more differently configured marking engines includes at least three two-color IOI drum modules to achieve at least six color marking capability.

6. The xerographic marking device system of claim 1, wherein one of the two or more differently configured marking engines includes an intermediate transfer unit that receives the first toned image and the second toned image from the photoreceptor in a single transfer, and transfers those toner images to print media transported along the paper path to produce a toned image on print media.

7. The xerographic marking device system of claim 1, further comprising a finishing module configured to be assembled to the common paper transport module.

8. The xerographic marking device system of claim 1, wherein toner within both the first and second development units are of a same polarity.

9. The xerographic marking device system of claim 1, wherein one of the two or more differently configured marking engines includes toner first and second marking materials of substantially the same or opposite hue.

10. The xerographic marking device system of claim 9, wherein at least one of the first development unit and the second development unit is a contact development unit.

11. The xerographic marking device of claim 1, wherein toner within both the first and second development units are of a same polarity.

12. The xerographic marking device of claim 1, wherein the first and second marking materials are of substantially the same or opposite hue.

13. A modular xerographic marking device, comprising:

a common paper transport module containing paper path components that define a paper path through the modular xerographic marking device and convey a sheet of paper from a paper inlet to a paper outlet;

an image output terminal cavity of fixed specified dimensions within the common paper transport module, the image output terminal cavity being exposed to a portion of the paper path; and two or more differently configured marking engines, each sized and configured to be provided and mounted within the image output terminal cavity of the common paper transport module to transfer marking material from the marking engine onto paper transported along the paper path, each of the different marking engines including at least one two-color IOI drum module including a) a first charging unit disposed along a rotatable photoconductive photoreceptor, wherein the first charging unit places a substantially uniform charge on the photoreceptor;

b) a first exposure unit disposed along the photoreceptor downstream of the first charging unit, wherein the first exposure unit performs an image-wise exposure to the photoreceptor to produce a first latent electrostatic image on the photoreceptor;

c) a first development unit disposed along the photoreceptor downstream of the first exposure unit, wherein the first development unit places a first marking material on the photoreceptor according to the first latent electrostatic image to produce a first toned image;

d) a second charging unit disposed on the photoreceptor downstream of the first exposure unit, wherein the second charging unit places a substantially uniform charge on the photoreceptor;

e) a second exposure unit disposed along the photoreceptor downstream of the second charging unit, wherein the second exposure unit performs an image-wise exposure to the photoreceptor to produce a second latent electrostatic image on the photoreceptor; and f) a second development unit disposed along the photoreceptor downstream of the second exposure unit, wherein the second development unit places a second marking material on the photoreceptor according to the second latent electrostatic image to produce a second toned image, wherein print media transported along the paper path receives the first toned image and the second toned image from the photoreceptor of the two-color IOI drum module in a single transfer to produce a toned image on print media.

14. The xerographic marking device of claim 13, wherein one of the two or more differently configured marking engines includes a single two-color IOI drum module.

15. The xerographic marking device of claim 14, wherein at least one of the marking engines enables one of high speed monochrome (K+K), matte black+gloss black (MK+GK), monochrome+highlight (K+1), monochrome+MICR (K+MICR), monochrome+clear coat (K+CC) and monochrome+gray (K+G) color functionality.

16. The xerographic marking device of claim 14, wherein another of the two or more differently configured marking engines includes two, two-color IOI drum modules and achieves full color marking capability.

17. The xerographic marking device of claim 13, wherein one of the two or more differently configured marking engines includes at least three two-color IOI drum modules to achieve at least six color marking capability.

18. The xerographic marking device of claim 13, wherein one of the two or more differently configured marking engines includes an intermediate transfer unit that receives the first toned image and the second toned image from the photoreceptor in a single transfer, and transfers those toner images to print media transported along the paper path to produce a toned image on print media.

19. The xerographic marking device of claim 13, further comprising a finishing module assembled to the common paper transport module.

20. A modular xerographic marking device system, comprising at least one modular xerographic marking device assembled from the following modular components:

a common paper transport module containing paper path components that define a paper path through the modular xerographic marking device and convey a sheet of paper from a paper inlet to a paper outlet;

an image output terminal cavity of fixed specified dimensions within the common paper transport module, the image output terminal cavity being exposed to a portion of the paper path; and two or more differently configured marking engines, each sized and configured to be provided and mounted within the image output terminal cavity of the common paper transport module to transfer marking material from the marking engine onto paper transported along the paper path, each of the different marking engines including at least one two-color 101 drum module including a) a first charging unit disposed along a rotatable photoconductive photoreceptor, wherein the first charging unit places a substantially uniform charge on the photoreceptor;

b) a first exposure unit disposed along the photoreceptor downstream of the first charging unit, wherein the first exposure unit performs an image-wise exposure to the photoreceptor to produce a first latent electrostatic image on the photoreceptor;

c) a first development unit disposed along the photoreceptor downstream of the first exposure unit, wherein the first development unit places a first marking material on the photoreceptor according to the first latent electrostatic image to produce a first toned image;

d) a second charging unit disposed on the photoreceptor downstream of the first exposure unit, wherein the second charging unit places a substantially uniform charge on the photoreceptor;

e) a second exposure unit disposed along the photoreceptor downstream of the second charging unit, wherein the second exposure unit performs an image-wise exposure to the photoreceptor to produce a second latent electrostatic image on the photoreceptor; and f) a second development unit disposed along the photoreceptor downstream of the second exposure unit, wherein the second development unit places a second marking material on the photoreceptor according to the second latent electrostatic image to produce a second toned image, wherein a first one of the marking devices includes a single two-color IOI drum module to achieve monochrome or monochrome+1 color capability, a second one of the marking devices includes two, two-color IOI drum modules to achieve full color capability, and a third one of the marking devices includes three or more two-color IOI drum modules to achieve 6+ color capability, and each of the at least one modular xerographic marking device is assembled from a combination of the common paper transport module and one of the marking engines mounted within the image output terminal cavity of the common paper transport module so that print media transported along the paper path can receive the first toned image and the second toned image from the photoreceptor from each two-color IOI drum module in a single transfer to produce a toned image on print media.

* * * * *